US007588163B1

(12) United States Patent
Wilson

(10) Patent No.: US 7,588,163 B1
(45) Date of Patent: Sep. 15, 2009

(54) DISPOSABLE SERVING SYSTEM HAVING A THUMB HOLE AND THUMB HOLE FLAP

(76) Inventor: Robert T. Wilson, 4423 Mohican Trail, Valrico, FL (US) 33594

( * ) Notice: Subject to any disclaimer, the term of this patent is extended or adjusted under 35 U.S.C. 154(b) by 296 days.

(21) Appl. No.: 11/715,124

(22) Filed: Mar. 7, 2007

Related U.S. Application Data

(60) Provisional application No. 60/780,731, filed on Mar. 9, 2006.

(51) Int. Cl.
*B65D 25/30* (2006.01)
*B65D 25/22* (2006.01)
*A47G 19/06* (2006.01)
*A47G 23/06* (2006.01)

(52) U.S. Cl. ..... 220/763; 220/574.1; 220/575; 220/762; 294/172; 294/25

(58) Field of Classification Search ..... 220/62, 220/62.1, 556, 574.1, 575, 762–764; 294/25, 294/172; D1/102, 105; D7/543, 548, 552.1
See application file for complete search history.

(56) References Cited

U.S. PATENT DOCUMENTS 2,295,860 A * 9/1942 Oliver ..... 294/172
2,669,379 A * 2/1954 Olson ..... 220/574
3,355,082 A * 11/1967 Wood ..... 294/131
3,446,416 A * 5/1969 Epstein ..... 206/557
3,708,086 A * 1/1973 Colato ..... 220/575
RE27,688 E * 6/1973 White et al. ..... 294/172
4,219,144 A * 8/1980 Hagelberg ..... 229/406
4,461,396 A * 7/1984 Harper ..... 220/23.83
5,152,398 A * 10/1992 Forestal et al. ..... 206/561
5,222,622 A * 6/1993 Laske, Jr. ..... 220/574.1
5,429,266 A * 7/1995 D'Oliveira et al. ..... 220/556
5,551,593 A * 9/1996 Wiens ..... 220/575
5,558,840 A * 9/1996 Jones et al. ..... 422/104
5,588,587 A * 12/1996 Stier et al. ..... 229/232
5,607,077 A * 3/1997 Torkelson ..... 220/575
5,609,375 A * 3/1997 Cohen ..... 294/25
5,638,981 A * 6/1997 Crane et al. ..... 220/574.1
5,662,240 A * 9/1997 Norris ..... 220/574
5,669,505 A * 9/1997 Mayer ..... 206/565
5,947,011 A 9/1999 Xu
5,950,856 A * 9/1999 Cinque ..... 220/23.4
6,129,235 A * 10/2000 Creske ..... 220/575
6,183,027 B1 * 2/2001 Tsao ..... 294/146
6,412,653 B1 * 7/2002 Waterhouse ..... 220/556
6,440,509 B1 * 8/2002 Littlejohn et al. ..... 428/35.7
6,609,625 B1 * 8/2003 Gibbar ..... 220/574
6,702,141 B1 * 3/2004 Cinque ..... 220/575
6,840,395 B2 * 1/2005 Agarwal et al. ..... 220/556
D501,364 S * 2/2005 Tranfaglia et al. ..... D7/543
7,152,754 B2 * 12/2006 Micciulla ..... 220/574
7,337,943 B2 * 3/2008 Johns et al. ..... 229/406
2003/0155785 A1 * 8/2003 Kitagawa et al. ..... 294/15
2005/0115974 A1 * 6/2005 Micciulla ..... 220/574
2006/0163259 A1 * 7/2006 Congiu et al. ..... 220/556

* cited by examiner

*Primary Examiner*—Anthony D Stashick
*Assistant Examiner*—Ned A Walker
(74) *Attorney, Agent, or Firm*—Edward P Dutkiewicz

(57) ABSTRACT

A plate has a periphery. The plate has an upper surface and a lower surface. A thickness is provided between the upper and lower surfaces. The plate has a plate center. The upper surface has at least one raised divider. The divider has a thumb hole. The plate also has a thumb flap.

4 Claims, 2 Drawing Sheets

FIG 2
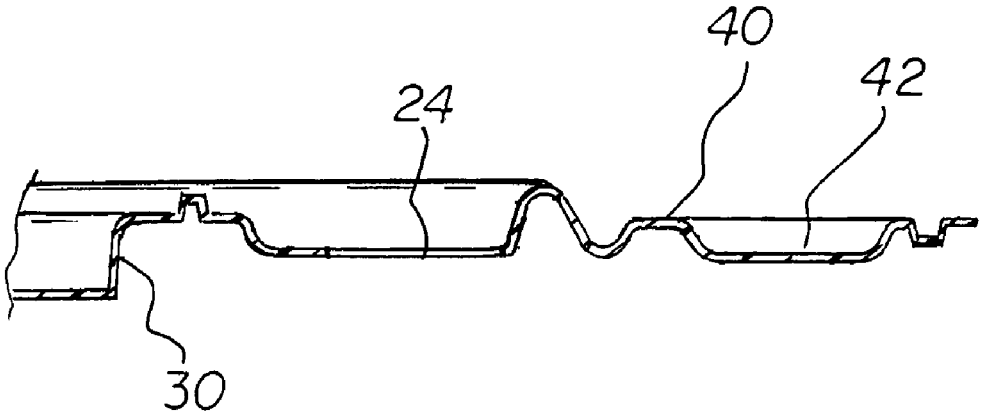
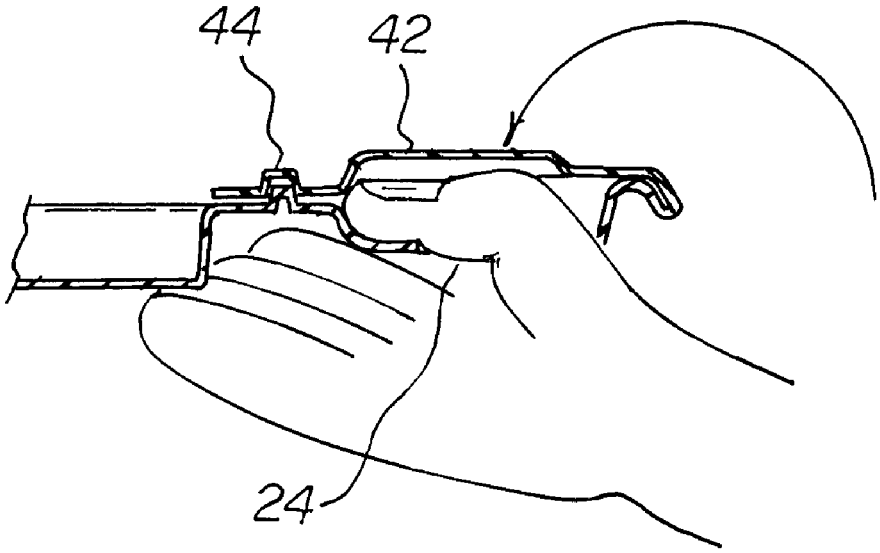
FIG 3

DISPOSABLE SERVING SYSTEM HAVING A THUMB HOLE AND THUMB HOLE FLAP

RELATED APPLICATION

The present non-provisional Patent Application is based upon provisional Patent Application Ser. No. 60/780,731 filed Mar. 9, 2006.

BACKGROUND OF THE INVENTION

1. Field of the Invention

The present invention relates to a disposable serving system and more particularly pertains to allowing a user to conveniently carry a disposable plate in a convenient and economical manner.

2. Description of the Prior Art

The use of serving systems of known designs and configurations is known in the prior art. More specifically, serving systems of known designs and configurations previously devised and utilized for the purpose of accomodating eaters are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,947,011 issued Sep. 7, 1999 to Xu relates to a Food Plate with Thumb and Beverage Container Aperture for Gripping and Holding with One Hand and U.S. Pat. No. 6,702,141 issued Mar. 9, 2004 relates to a One-Handed Refreshment Center.

While these devices fulfill their respective, particular objectives and requirements, the aforementioned patents do not describe a disposable serving system that allows allowing a user to conveniently carry a disposable plate in a convenient and economical manner.

In this respect, the disposable serving system according to the present invention substantially departs from the conventional concepts and designs of the prior art, and in doing so provides an apparatus primarily developed for the purpose of allowing a user to conveniently carry a disposable plate in a convenient and economical manner.

Therefore, it can be appreciated that there exists a continuing need for a new and improved disposable serving system which can be used for allowing a user to conveniently carry a disposable plate in a convenient and economical manner. In this regard, the present invention substantially fulfills this need.

SUMMARY OF THE INVENTION

In view of the foregoing disadvantages inherent in the known types of serving systems of known designs and configurations now present in the prior art, the present invention provides an improved disposable serving system. As such, the general purpose of the present invention, which will be described subsequently in greater detail, is to provide a new and improved disposable serving system and method which has all the advantages of the prior art and none of the disadvantages.

To attain this, the present invention essentially comprises a disposable serving system. First provided is a plate. The plate has a periphery. The plate has an upper surface and a lower surface. A thickness is provided between the upper and lower surface. The plate has a plate center. The upper surface has at least one raised radially oriented divider. A radially oriented thumb hole is provided the divider. The center has a centrally located generally round drinking cup receiving area. The cup area has a raised border. The border runs circumferentially around the cup area. The thumb hole is sized to accommodate a user's thumb. In this manner the user's thumb lies in a radial orientation relative to the center of the plate.

A thumb flap is provided next. The thumb flap is associated with the plate and the thumb hole. The thumb flap has a generally Y-shaped configuration. The thumb flap is located on the periphery of the plate. The thumb flap is foldable in a radial direction relative to the center of the plate. The flap is configured to cover a user's thumb that passes through the plate thumb hole. The flap has a domed area. The thumb flap has an associated fastener. The fastener separably couples the thumb flap over the thumb hole. The fastener is selected from the class of fasteners. The class of fasteners includes tabs, snaps, tongues and slots, lips, clips and adhesives.

Provided last are eating utensils. The eating utensils are removably coupled to the periphery of the plate. The eating utensils include a knife and a fork and a spoon.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved disposable serving system which has all of the advantages of the prior art serving systems of known designs and configurations and none of the disadvantages.

It is another object of the present invention to provide a new and improved disposable serving system which may be easily and efficiently manufactured and marketed.

It is further object of the present invention to provide a new and improved disposable serving system which is of durable and reliable constructions.

An even further object of the present invention is to provide a new and improved disposable serving system which is susceptible of a low cost of manufacture with regard to both materials and labor, and which accordingly is then susceptible of low prices of sale to the consuming public, thereby making such disposable serving system economically available to the buying public.

Even still another object of the present invention is to provide a disposable serving system for allowing a user to conveniently carry a disposable plate in a convenient and economical manner.

Lastly, it is an object of the present invention to provide a new and improved disposable serving system. A plate has a periphery. The plate has an upper surface and a lower surface. A thickness is provided between the upper and lower surfaces. The plate has a plate center. The upper surface has at least one raised divider. The divider has a thumb hole. The plate also has a thumb flap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross sectional view taken along line 2-2 of FIG. 1.

FIG. 3 is a cross sectional view similar to FIG. 2 but showing a thumb of a user and a thumb flap in position during use.

The same reference numerals refer to the same parts throughout the various Figures.

DESCRIPTION OF THE PREFERRED EMBODIMENT

Figure 1:
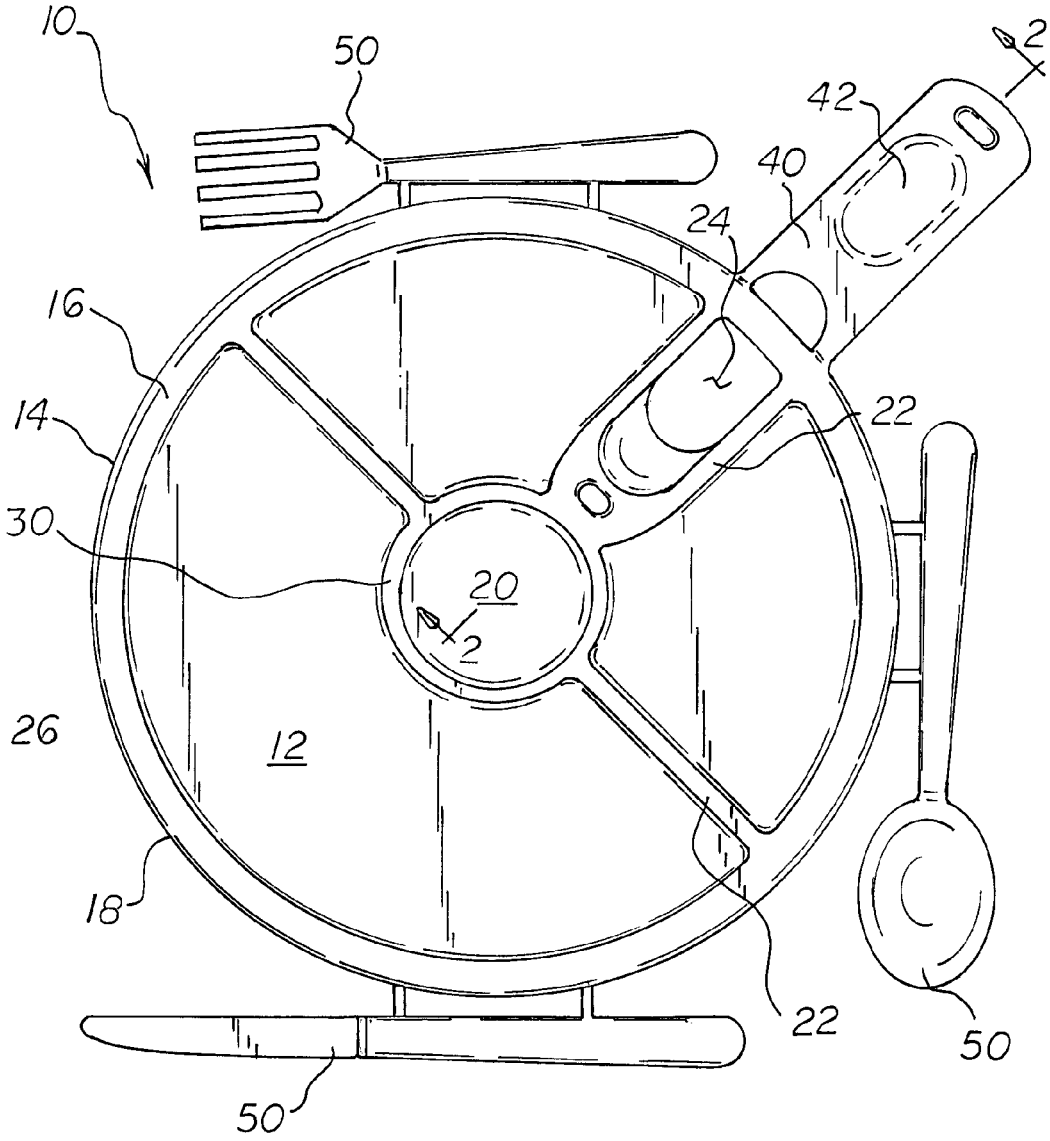
FIG. 1 is plan view of a disposable serving system constructed in accordance with the principles of the present invention.

With reference now to the drawings, and in particular to FIG. 1 thereof, the preferred embodiment of the new and improved disposable serving system embodying the principles and concepts of the present invention and generally designated by the reference numeral 10 will be described.

The present invention, the disposable serving system 10 is comprised of a plate. The plate is configured as to attain the desired objective.

First provided is a plate 12. The plate has a periphery 14. The plate has an upper surface 16 and a lower surface 18. A thickness is provided between the upper and lower surface. The plate has a plate center 20. The upper surface has at least one raised radially oriented divider 22. A radially oriented thumb hole 24 is provided the divider. The center has a centrally located generally round drinking cup receiving area. The cup area has a raised border 30. The border runs circumferentially around the cup area. The thumb hole is sized to accommodate a user's thumb. In this manner the user's thumb lies in a radial orientation relative to the center of the plate.

A thumb flap 40 is provided next. The thumb flap is associated with the plate and the thumb hole. The thumb flap has a generally Y-shaped configuration. The thumb flap is located on the periphery of the plate. The thumb flap is foldable in a radial direction relative to the center of the plate. The flap is configured to cover a user's thumb that passes through the plate thumb hole. The flap has a domed area 42. The thumb flap has an associated fastener 44. The fastener separably couples the thumb flap over the thumb hole. The fastener is selected from the class of fasteners. The class of fasteners includes tabs, snaps, tongues and slots, lips, clips and adhesives.

Provided last are eating utensils 50. The eating utensils are removably coupled to the periphery of the plate. The eating utensils includes a knife and a fork and a spoon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A disposable serving system comprising:

a plate having a periphery and an upper surface and a lower surface with a thickness there between and a plate center, the upper surface having at least one raised divider with a thumb hole, the plate also having a thumb flap wherein the thumb flap is a generally Y-shaped thumb flap located on the periphery of the plate with the thumb flap being foldable in a radial direction relative to the center of the plate and the thumb flap being configured to cover the user's thumb that passes through the plate thumb hole.

2. A disposable serving system comprising:

a plate having a periphery and an upper surface and a lower surface with a thickness there between and a plate center, the upper surface having at least one raised divider with a thumb hole, the plate also having a thumb flap, the plate further including a fastener for separably coupling the thumb flap over the thumb hole.

3. The disposable serving system as set forth in claim 2 wherein the fastener is selected from the class of fasteners including tabs, snaps, tongues and slots, lips, clips and adhesives.

4. A disposable serving system for allowing a user to conveniently carry a disposable plate in a convenient and economical manner comprising, in combination:

a plate having a periphery with an upper surface and a lower surface and with a thickness there between and with a plate center, the upper surface having at least one raised radially oriented divider with a radially oriented thumb hole through the divider, the center having a centrally located generally round drinking cup receiving area with the cup area having a raised border running circumferentially around the cup area, the thumb hole being oriented so that the user's thumb lies in a radial orientation relative to the center of the plate;

a thumb flap associated with the plate and the thumb hole, the thumb flap having a generally Y-shaped configuration and located on the periphery of the plate with the thumb flap being foldable in a radial direction relative to the center of the plate, the flap being configured to cover a user's thumb that passes through the plate thumb hole and with the flap having a domed area, the thumb flap having an associated fastener for separably coupling the thumb flap over the thumb hole, the fastener being selected from the class of fasteners including tabs, snaps, tongues and slots, lips, clips and adhesives; and eating utensils removably coupled to the periphery of the plate, the eating utensils including a knife and a fork and a spoon.

* * * * *